US007555248B2

(12) United States Patent
Tanda

(10) Patent No.: US 7,555,248 B2
(45) Date of Patent: Jun. 30, 2009

(54) DEVELOPING UNIT CONNECTION FOR TONER SUPPLY DEVICE

(75) Inventor: Tetsuo Tanda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 411 days.

(21) Appl. No.: 11/276,359

(22) Filed: Feb. 27, 2006

(65) Prior Publication Data

US 2006/0193659 A1 Aug. 31, 2006

(30) Foreign Application Priority Data

Feb. 25, 2005 (JP) ..... 2005-051410

(51) Int. Cl.
*G03G 15/08* (2006.01)

(52) U.S. Cl. ..... 399/258

(58) Field of Classification Search ..... 399/227, 399/258, 260

See application file for complete search history.

(56) References Cited

U.S. PATENT DOCUMENTS 6,752,965 B2 * 6/2004 Levy
2002/0122104 A1 * 9/2002 Hatasa et al.
2004/0197119 A1 * 10/2004 Matsumoto et al. ..... 399/258

FOREIGN PATENT DOCUMENTS

| | | | | |
|---|---|---|---|---|
| JP | 05046022 | A | * | 2/1993 |
| JP | 05046023 | A | * | 2/1993 |
| JP | 10/198149 | A | | 7/1998 |
| JP | 2000043288 | A | * | 2/2000 |
| JP | 2001/134045 | A | | 5/2001 |
| JP | 2001201926 | A | * | 7/2001 |
| JP | 2004299410 | A | * | 10/2004 |

* cited by examiner

*Primary Examiner*—Susan S Lee
(74) *Attorney, Agent, or Firm*—Shinjyu Global IP

(57) ABSTRACT

A developing unit is disclosed that includes a sub rotary developing unit, a toner supply device, and a drive device. The sub rotary developing unit has a developing roller in the interior thereof, and an elastic seal made of an elastic member with a slit sealing an opening on the sub rotary developing unit. The toner supply device supplies toner from a nozzle at the tip thereof to the sub rotary developing unit. The drive device drives the tip of the nozzle of the toner supply device into the sub rotary developing unit through the slit on the elastic seal in order for the toner supply device to supply toner into the sub rotary developing unit, and pulls the tip away when toner is properly supplied.

7 Claims, 8 Drawing Sheets

DEVELOPING UNIT CONNECTION FOR TONER SUPPLY DEVICE

BACKGROUND OF THE INVENTION

1. Field of the Invention

The present invention relates to a developing unit. More specifically, the present invention relates to a developing unit to which toner is supplied from a separate unit.

2. Background Information

Some developing units of image forming devices are constructed such that a fixed amount of toner is charged into the developing unit. The developing units are replaced when the toner runs out, which economically, is not preferable. On the other hand, if the amount of toner filled inside the developing units is increased, it will be difficult to miniaturize the developing unit.

In order to miniaturize the developing unit, the idea of having toner supplied from a separate unit has been proposed, as disclosed in Japan Unexamined Patent Publication No. 2001-134045. In the rotary developing system disclosed therein, a plurality of developing units are held in a rotary frame. A joint connects the toner supply device to the rotary developing unit. The toner supply device and the joint slide to open a shutter mechanism, allowing the joint to connect to a sub rotary developing unit stopped at a determined position.

In a conventional developing unit where toner is supplied from a separate unit, the joint mechanism, which connects the rotary portion in the rotary frame with a toner supply portion of the main body, and the shutter mechanism are required. However, the structure of the joint and the shutter mechanisms is too complex. In addition, since the sliding mechanism of the joint is required in addition to the rotary frame, miniaturization of the developing unit is possible only to a certain extent. Another invention disclosed in Japan Unexamined Patent Publication No. 10-198149 proposes the use of a pipe to supply toner instead. However, the tip of the toner supply pipe is open at all times, and no shutter mechanism is provided at the developing unit end. A problem in which the toner might splash out while supplying toner is not being considered.

In view of the above, it will be apparent to those skilled in the art from this disclosure that there exists a need for an improved developing unit. This invention addresses this need in the art as well as other needs, which will become apparent to those skilled in the art from this disclosure.

SUMMARY OF THE INVENTION

It is an object of the present invention to make the structure of the joint that connects the sub rotary developing units with the toner supply device, and the shutter mechanism simple.

Another object of the present invention is to provide a developing unit with a toner supply mechanism that supplies toner without splashing toner.

Another object of the present invention is to increase the life of the toner supply mechanism.

According to a first aspect of the present invention, a developing unit comprises a case, a toner supply device, and a drive device. The case has a developing roller in the interior thereof, and an elastic seal made of an elastic member with a slit sealing an opening on the case. The toner supply device supplies toner from a nozzle at the tip thereof to the case. The drive device drives the tip of the nozzle of the toner supply device into the case through the slit on the elastic seal in order for the toner supply device to supply toner into the case, and pulls the tip away when toner is properly supplied.

In this developing unit, the shutter mechanism and the simple structure of the joint mechanism connecting the case and the toner supply device make it easy to supply toner, and prevent toner from splashing.

A developing unit according to a second aspect of the present invention has a toner supply device comprising an inner cylinder having an inner opening at the tip thereof, and an outer cylinder relatively rotatable about the inner cylinder on an outer circumference of the inner cylinder having an outer opening at the tip thereof. The toner supply device further comprises a shutter mechanism constructed such that when the tip of the toner supply device advances into the case, at least a portion of the inner opening and the outer opening is overlapped. On the other hand, when the tip is positioned outside the case, the inner opening and the outer opening are misaligned with each other.

In this developing unit, a shutter mechanism having a simple structure is arranged in the toner supply device in order to prevent toner from splashing. That is, when in a closed position, the openings on the inner cylinder and the outer cylinder do not line up; therefore, toner does not flow out. In addition, when the tip of the toner supply device is detached from the case, it is in a closed position to prevent toner from splashing.

In a developing unit according to a third aspect of the present invention, the outer opening of the toner supply device is formed at the tip of the outer cylinder along a portion of the circumference thereof such that the outer opening and the slit are positioned approximately parallel with each other when the nozzle passes through the slit. This will allow the seal to have high durability, eliminating the possibility of the seal being torn by the force of insertion, as well as other harmful effects.

In a developing unit according to a fourth aspect of the present invention, when the toner supply device passes through the slit, the outer cylinder and the inner cylinder start to rotate relative to each other, and when the nozzle, comprised of the openings of the inner cylinder and the outer cylinder, is completely accommodated in the case, the outer opening and the slit are approximately perpendicular. Accordingly, it is possible to prevent the elastic seal from covering the opening of the nozzle, thereby allowing the proper amount of toner to be supplied.

In a developing unit according to a fifth aspect of the present invention, the opening of the case is in the form of a polygon. Here, although pressure is being applied to the elastic seal when the nozzle advances into the case, the polygonal shape of the opening enables the pressure to be distributed, thereby increasing the life of the elastic seal.

In a developing unit according to a sixth aspect of the present invention, the elastic seal comprises a plurality of laminated elastic sheets each having a slit in a different direction with respect to the opening surface of the nozzle. This allows the nozzle to easily advance into the case.

In a developing unit according to a seventh aspect of the present invention, the elastic seal has a plurality of laminated elastic sheets, each having a slit extending in a different direction. This allows the nozzle to easily advance into the case, and prevents the toner from leaking out of the container.

In a developing unit according to an eighth aspect of the present invention, at least one of the surface of the slit of the elastic seal and the surface of the elastic seal are surface treated. This allows the nozzle to easily advance into the case, thereby increasing the life of the elastic seal.

In a developing unit according to a ninth aspect of the present invention, the outer opening of the outer cylinder has an opening angle larger than that of the inner opening of the inner cylinder.

In a developing unit according to a tenth aspect of the present invention, the elastic seal is formed from one selected from the group consisting of a microcell polymer sheet, an urethane foam, a rubber member, a felt, a PET film, a Teflon sheet, and an ultrahigh molecular polyethylene sheet.

In a developing unit according to an eleventh aspect of the present invention, the surface of the elastic seal is treated with a lubricant.

In a developing unit according to a twelfth aspect of the present invention, the elastic seal includes a plurality of slits extending in different directions.

In a developing unit according to a thirteenth aspect of the present invention, at least one of the surfaces of the slit of the elastic seal and the surface of the elastic seal are surface treated.

The present invention provides a simple joint mechanism connecting the toner supply device to the case in order to supply toner. Furthermore, it is possible to prevent toner from splashing when supplying toner, and increase the life of the toner supply mechanism.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
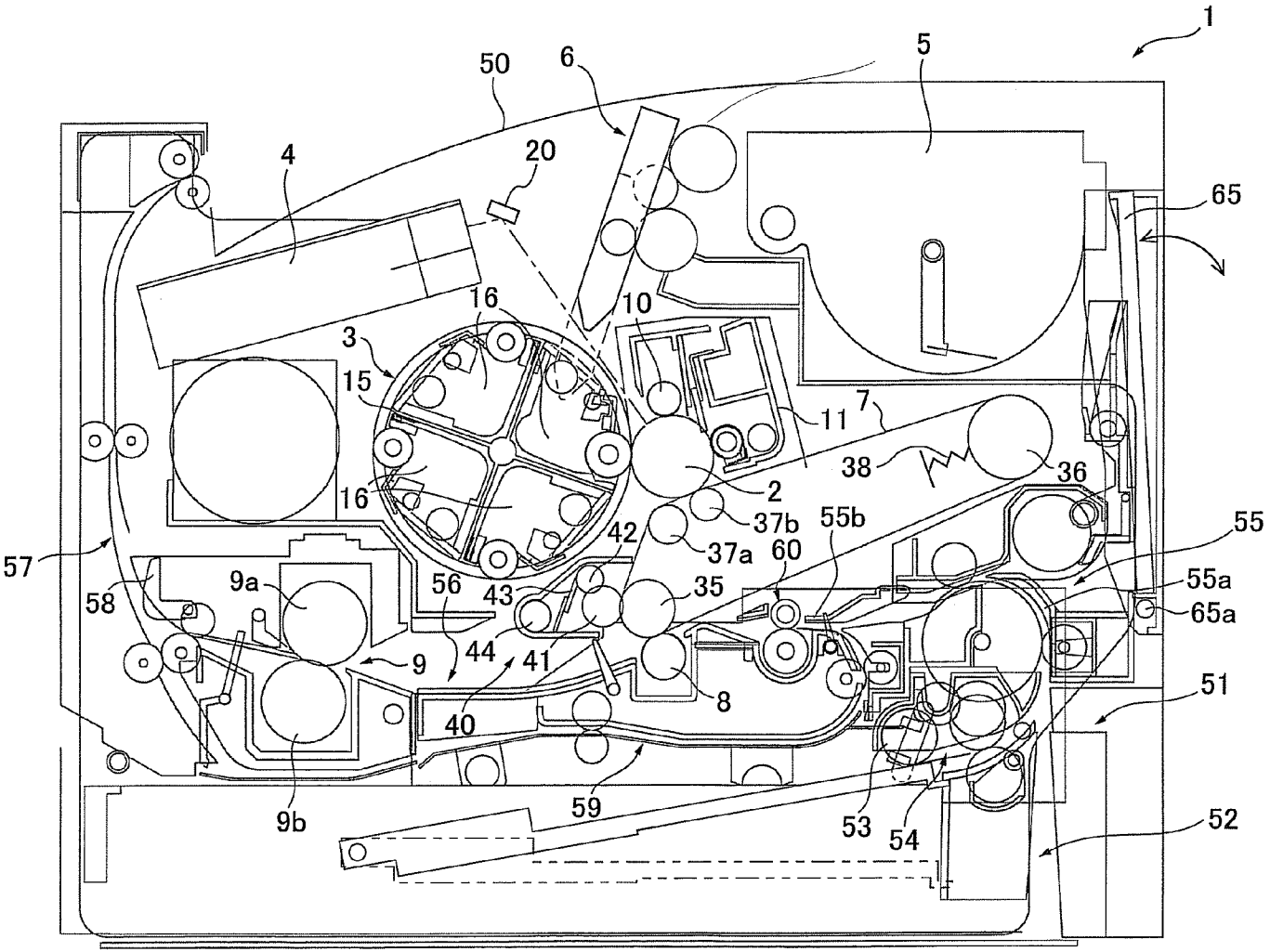
FIG. 1 is a schematic structural view of a color printer according to one embodiment of the present invention.

FIG. 1 shows a color printer 1 as a color image forming device that employs developing units according to an embodiment of the present invention. It is an overall structural view showing the locations of each of the components inside the color printer 1.

Overall Structure

The color printer 1 is connected to a device, such as a computer, not shown in the drawings. It is capable of printing a color image on a print sheet based on image data received from the computer. The right hand side of FIG. 1, hereinafter referred to as the "right side", is where an operator operates the color printer 1. On the other hand, the left hand side of FIG. 1 will be referred to as the "left side".

The color printer 1 comprises a photosensitive drum 2, a rotary developing device 3, a laser unit 4 as an exposure unit, a toner container 5, a toner supply device 6, an intermediate transfer belt 7, a secondary transfer roller 8, and a fixing device 9.

Photosensitive Drum

The photosensitive drum 2 is mounted substantially in the center of the device, and able to rotate freely. An electrostatic latent image of the image data is formed on the surface of the photosensitive drum 2. The rotational shaft of the photosensitive drum 2 is located such that the axis extends in a lateral direction when seen from the right side of the device, i.e., in the direction perpendicular to the plane of the section of FIG. 1, if it were a section. This direction hereinafter referred to as the "lateral direction". On top of the photosensitive drum 2 is a charge roller 10, mounted for uniformly charging the surface of the photosensitive drum 2. To the right hand side of the photosensitive drum 2 is a drum cleaning device 11, mounted for cleaning the residuals on the surface of the photosensitive drum 2.

Rotary Developing Device

The rotary developing device 3 is a device for developing the electrostatic latent image formed on the photosensitive drum 2 with various color toners. The rotary developing device 3 is located adjacent to the photosensitive drum 2, with its center approximately lined up with the center of the photosensitive drum 2. The rotary developing device 3 comprises a rotary frame 15, in the interior of which are four sub rotary developing units 16 containing four color toners. The rotary frame 15 is a cylindrical member rotatable around an axis parallel with the rotational shaft of the photosensitive drum 2. It is driven by a drive mechanism comprising a motor and gears, not shown in the drawings. In addition, the rotary frame 15 has four compartments dividing the rotary frame 15 into quarters, with partitions extending from the center of the rotational axis radially outward. Each of the compartments accommodates each of the sub rotary developing units 16, containing four color toners of yellow, cyan, magenta, and black in the four compartments separately.

Figure 2:
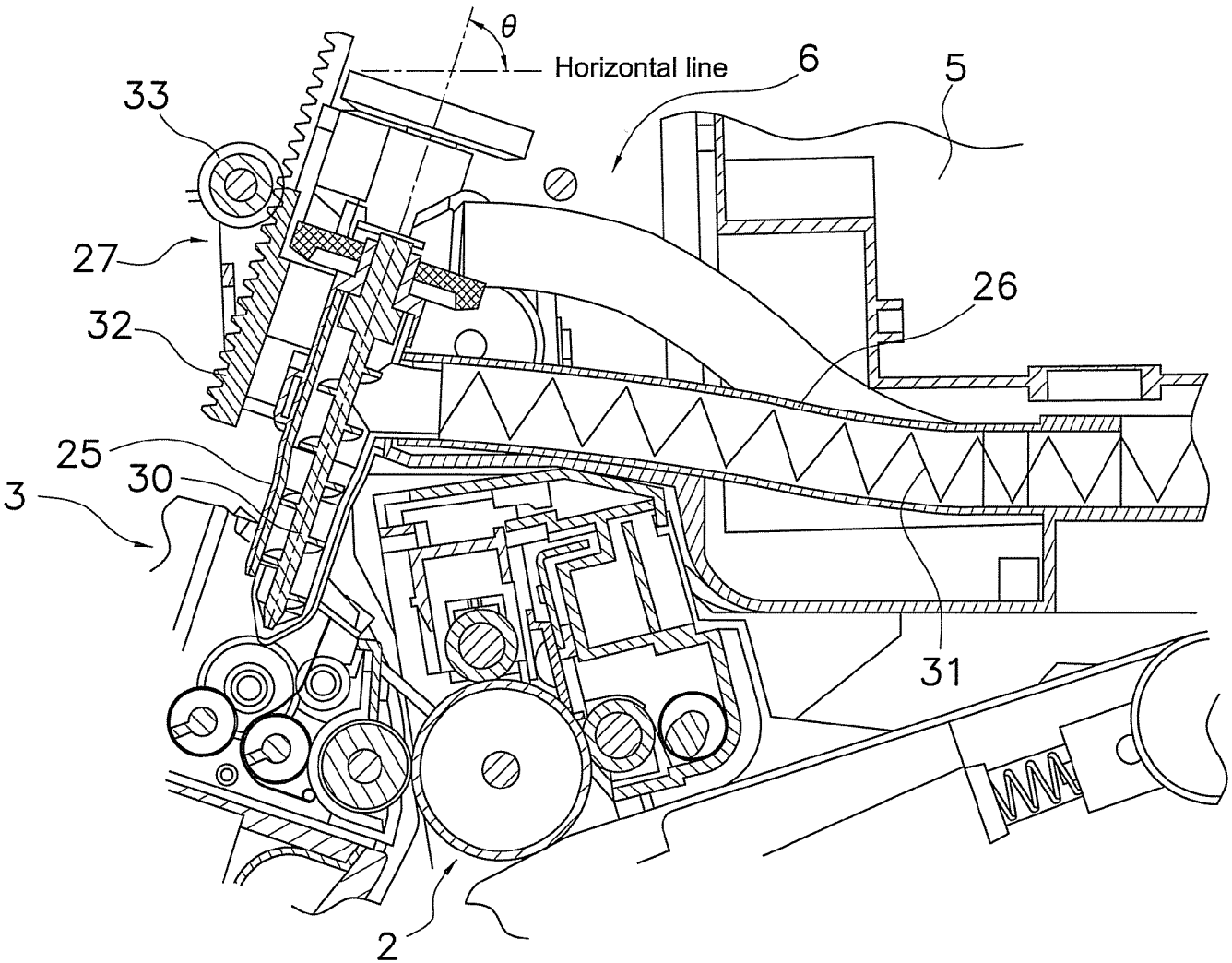
FIG. 2 is a detailed sectional structural view of a toner supply device.
Figure 3:
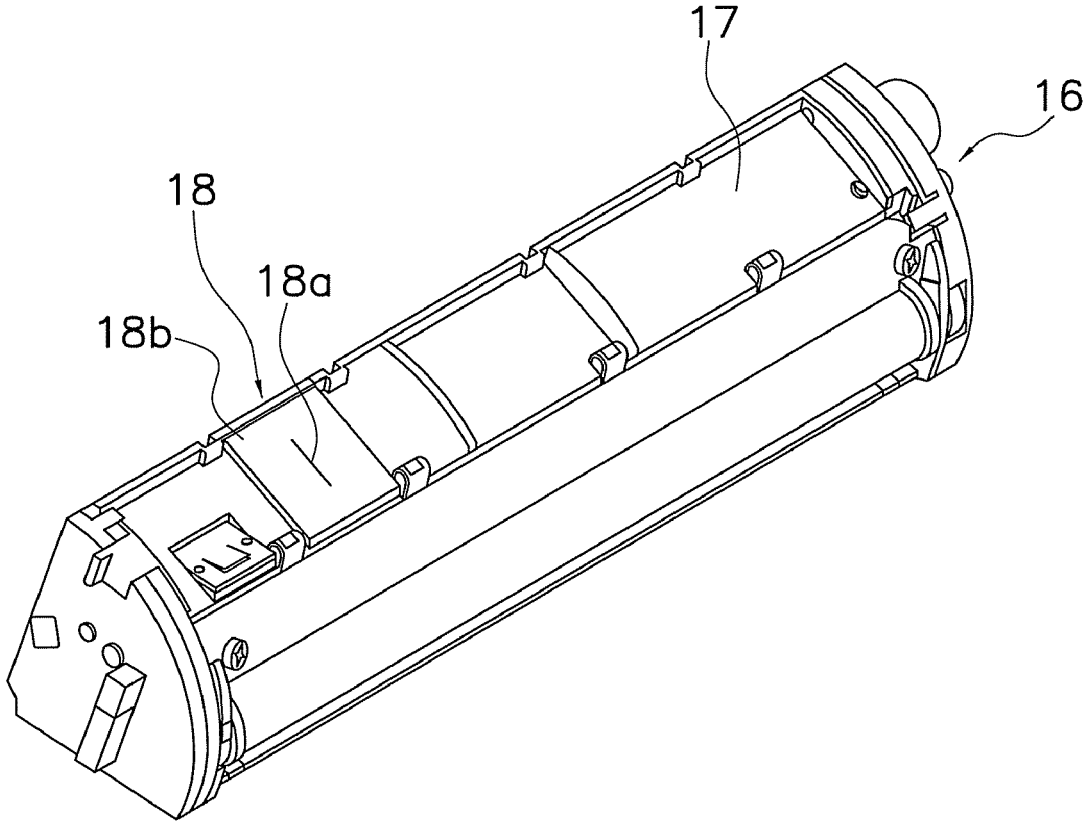
FIG. 3 is an external perspective view of a sub rotary developing unit.

The structure of each the sub rotary developing units 16 is substantially the same. Each comprises a developing roller capable of moving into a position in contact with the photosensitive drum 2, and an agitation roller for agitating the toner. A sub rotary developing unit 16 is shown in FIG. 2. Since a toner container that contains toner for supplying the sub rotary developing unit 16 is separately provided, the sub rotary developing unit itself has a smaller toner capacity. Thus, the size of the sub rotary developing unit 16 has been reduced, compared to a conventional device comprising a toner container inside the sub rotary developing unit. In addition, each sub rotary developing unit 16 is detachable. Furthermore, toner can be supplied from the toner container to the inside of a sub rotary developing unit 16 from the toner supply portion 18 on the case 17 of the sub rotary developing unit 16, as shown in FIG. 3.

The toner supply portion 18 is an elastic member 18*b* with a slit 18*a* that seals the rectangular opening on the case 17. The elastic member 18*b* can be formed from a microcell polymer sheet, an urethane foam, a rubber member, a felt, a PET film, a Teflon sheet, an ultrahigh molecular polyethylene sheet, or the like.

In addition, the surface of the elastic member 18*b* and at least one side of the slit 18*a* are surface treated with a lubricant in order to reduce frictional resistance and protect the elastic member 18*b*. Moreover, the slit 18*a* is closed except during the time when toner is supplied.

Laser Unit

The laser unit 4 is a device used to scan and expose the photosensitive drum 2 based on image data from the external computer. It is located on the upper left side of the photosensitive drum 2 and the rotational shaft of the rotary developing device 3. The laser emitting end of the laser unit 4 is located immediately above the rotational shaft of the rotary developing device 3, and the height of the other end is below the height of the upper surface of the rotary developing device 3 to the left. The entire laser unit 4 is tilted, with the laser emitting end tilting upward. The inner structure of the laser unit 4 is the same as the structure of a conventional laser unit, comprising a laser light source, a polygon mirror, a motor for driving the polygon mirror, and so on. In addition, the laser light emitted from the laser unit 4 will strike a reflective mirror 20, which reflects the laser light onto the surface of the photosensitive drum 2.

Toner Container

The toner container 5 stores toner to be supplied to each of the sub rotary developing units 16 of the rotary developing device 3. It is located above the photosensitive drum 2 to the right side, and at the opposite end from the laser unit 4. The toner container 5 comprises four containers arranged in a lateral direction, storing yellow, cyan, magenta, and black color toners. The toner container 5 can be taken out from the right side of the device.

Toner Supply Device

The toner supply device 6 supplies toner to the sub rotary developing units 16 from the toners contained in the toner container 5. It is located above the photosensitive drum 2 and in between the laser unit 4 and the toner container 5. As shown in FIG. 2, the toner supply device 6 comprises four toner supply pipes 25 that are able to move up and down, four conveyance pipes 26 for connecting the color toners in the toner container 5 with the corresponding toner supply pipes 25, and a drive mechanism 27 for moving the toner supply pipes 25 in the vertical direction.

The toner supply pipe 25 extends vertically downward, towards the sub rotary developing units 16. The toner supply pipe 25 has a tapered tip, which can advance into the sub rotary developing unit 16 through the slit 18*a*. Inside of the toner supply pipe 25, a toner conveyance screw 30 for conveying the toner is rotatably installed.

The conveyance pipe 26 is flexible and follows the vertical movement of the toner supply pipe 25. Inside the conveyance pipe 26, a coil spring 31 conveys the toner inside to the toner supply pipe 25 when the coil spring 31 is rotated by a drive mechanism (not shown in the drawing).

Figure 4A:
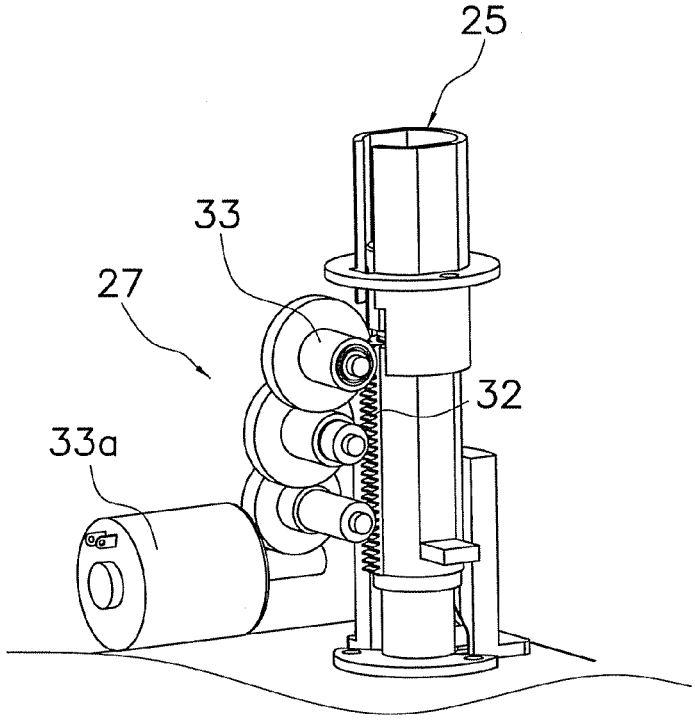
FIG. 4A is a perspective view of a toner supply pipe.
Figure 4B:
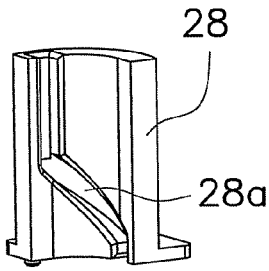
FIG. 4B is a detailed drawing showing a rotary cam and a spiral flute.

The drive mechanism 27 is comprised of racks 32 located on the outer circumference of the toner supply pipes 25 extending in the axial direction of the pipes 25, and pinion gears 33 engaging with the racks 32. The pinion gears 33 are rotatably supported by the frame of the device and driven by motors 33*a*, a worm, a worm wheel, and reduction gears as shown in FIG. 4(*a*). The drive mechanism 27 moves the four toner supply pipes 25 back and forth from a retracted position, shown in solid lines in FIG. 1, to a supply position, shown in dashed lines in FIG. 1. In a supply position, the tip is inserted into the sub rotary developing unit 16. However, the path of the movement of the toner supply pipes 25 hinders the path of the laser light emitting from the laser unit 4. When the toner supply pipes 25 are in the retracted position, they do not block the path of the laser light. However, when they are in the supply position, the path of the laser light is blocked.

Figure 5A:
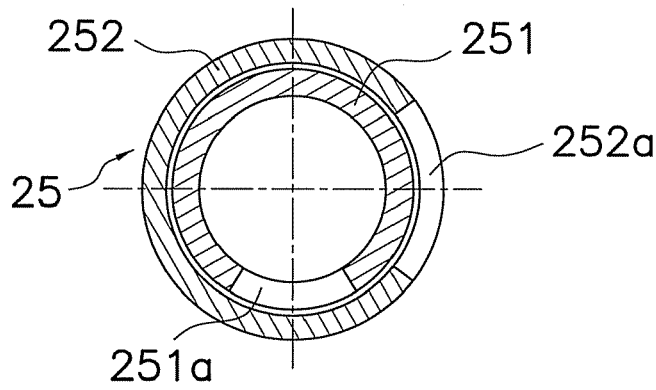
FIGS. 5A-C are sectional views of the tip of the toner supply pipe.
Figure 5B:
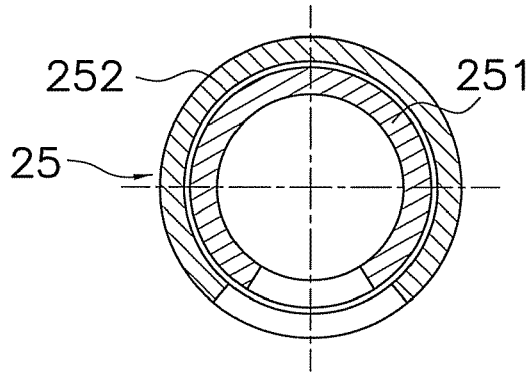
Figure 5C:
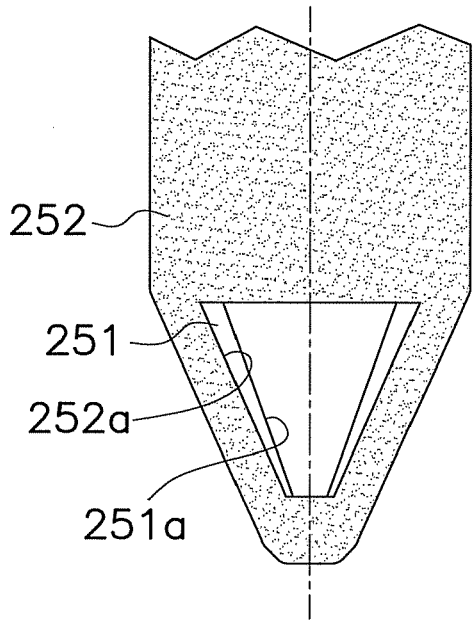
Figure 6A:
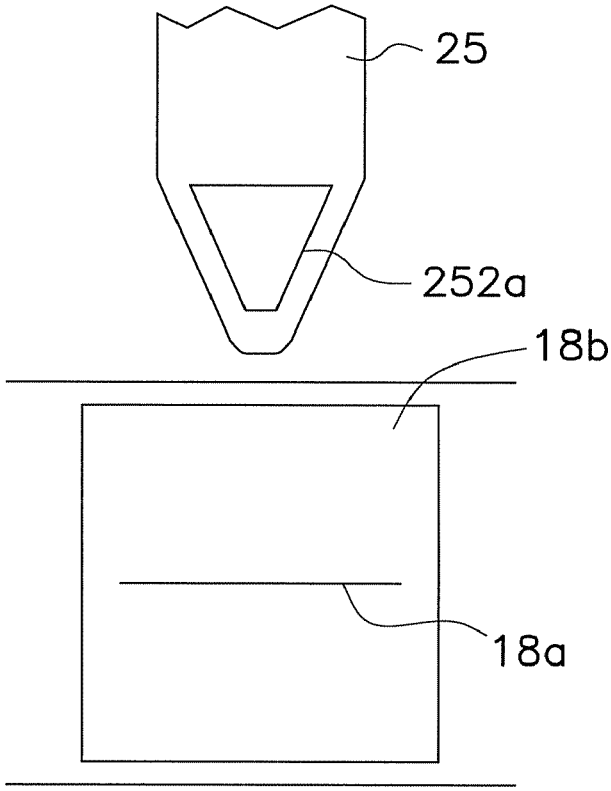
FIGS. 6A-C are views showing the toner supply pipe before and after passing through an elastic member.
Figure 6B:
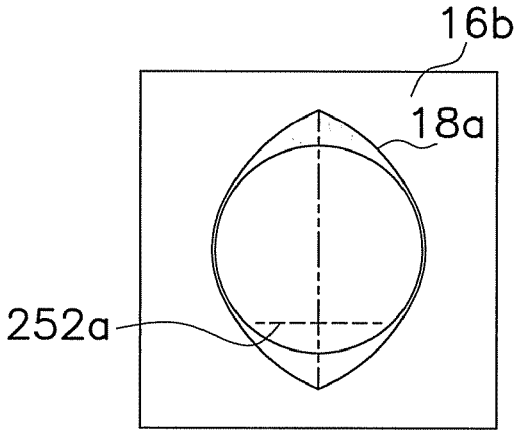
Figure 6C:
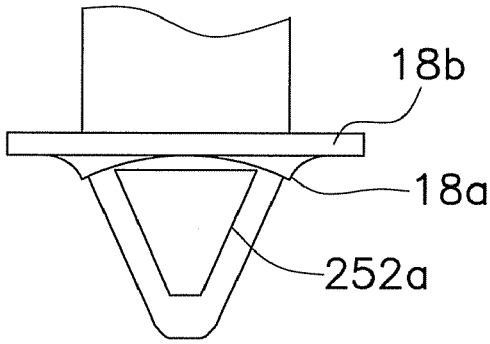
Figure 8:
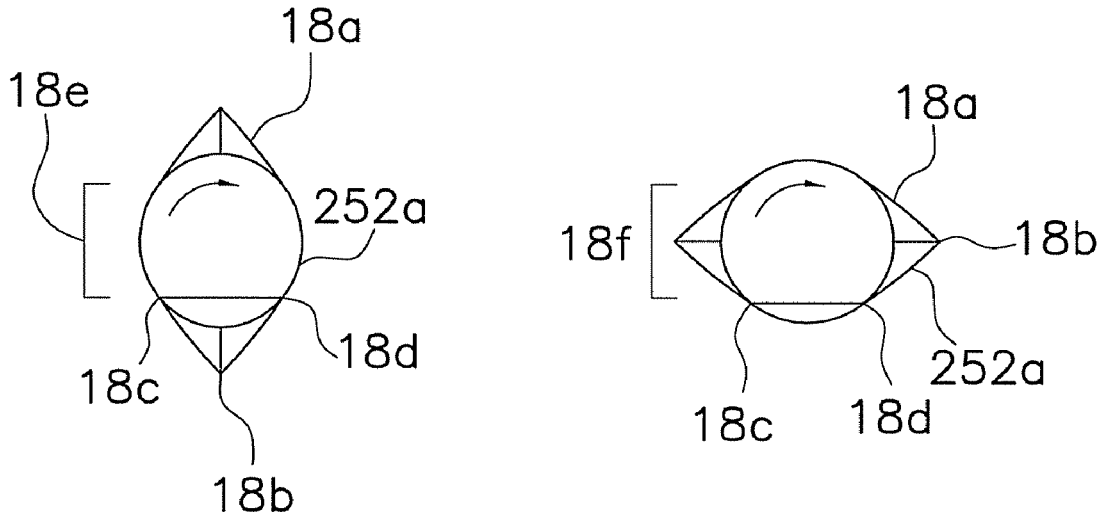
FIG. 8 shows two diagrams illustrating the line of an opening 252*a* of an outer cylinder 252 and the line connecting the end points of a slit 18*a* of the elastic seal perpendicular (left diagram) and parallel (right diagram) with each other.

Note that the toner supply pipe 25 has a shutter mechanism which opens only when the toner supply pipe 25 is in the supply position. As shown in FIGS. 5A-C, the toner supply pipe 25 has a layered structure with an inner cylinder 251 and an outer cylinder 252. The tips of the cylinders are formed with openings 251*a* and 252*a* having a circumferential length, respectively. The opening 252*a* of the outer cylinder 252 has an opening angle larger than the opening 251 a of the inner cylinder 251. In addition, as shown in FIG. 4(*a*) and FIG. 4(*b*), the outer cylinder 252 is formed with a protrusion on the outer circumferential surface. The protrusion engages with a rotary cam 28 consisting spiral flutes 28*a* further around the perimeter of the outer cylinder. Note that in FIG. 4(*b*), the rotary cam 28 is shown in a disassembled manner. When the toner supply pipe 25 is not in the supply position, the line connecting the two ends of opening 252*a* (hereinafter referred to as the line of the opening 252*a*) and the line connecting the two end points of the slit 18*a* (hereinafter referred to as the line of the slit) are parallel with each other as shown in FIG. 6(*a*). The opening 251*a* and the opening 252*a* do not line up, indicating a closed shutter, as shown in FIG. 5(*a*)), which prohibits toner from flowing out. Note that the line of the opening 252*a* refers to the straight line connecting an end of the opening 18*c* with another end of the opening 18*d*, shown in FIG. 8. On the other hand, when the toner supply pipe 25 moves downward, the outer cylinder 252 is rotated by the engagement of the protrusion and the rotary cam 28. The tip of the toner supply pipe 25 is inserted into the sub rotary developing unit 16. And, when the toner supply pipe 25 is in the supply position, the line of the opening 252*a* and the line of the slit 18*a* are approximately perpendicular, as shown in FIGS. 6(*c*) and (*d*), and the opening 251*a* and the opening 252*a* are aligned with each other to open the shutter, as shown in FIG. 5(*b*), and allow toner to flow inside the sub rotary developing unit 16.

Intermediate Transfer Belt

The intermediate transfer belt 7 is located below the photosensitive drum 2 and the toner container 5. The toner images formed on the photosensitive drum 2 are sequentially transferred onto the surface of the intermediate transfer belt 7. The intermediate transfer belt 7 is looped over a driving roller 35 and a follower roller 36, on the opposite ends. A portion of the transfer belt 7 is brought in contact with the photosensitive drum 2 by a pair of primary transfer rollers 37*a* and 37*b*.

The driving roller 35 is located directly below the contact point of the photosensitive drum 2 and the rotary developing device 3. The center of the driving roller 35 is positioned at a height below the bottom surface of the rotary developing device 3. The driving roller 35 is driven by a driving unit including a motor and a gear, not shown in the figure. The follower roller 36 is located below the toner container 5 towards the right side, and positioned in approximately the same height as the photosensitive drum 2. The spring 38 forces the follower roller 36 to the opposite direction from the driving roller 35, creating a predetermined tension on the intermediate transfer belt 7. In addition, the primary transfer rollers 37*a* and 37*b* are located adjacent to each other below the photosensitive drum 2 allowing a determined range of the transfer belt 7 to be in contact with the photosensitive drum 2.

A belt cleaning device 40 cleans the transfer belt 7. It is located on the left side of the driving roller 35 and below the rotary developing device 3. The belt cleaning device 40 comprises a fur brush 41 sliding in contact and sandwiching the transfer belt 7 with the driving roller 35, a cleaning roller 42 located above and in contact with the fur brush 41, a blade 43 with a tip in contact with the surface of the cleaning roller 42, and a recovery spiral 44 located below the blade 43.

In this cleaning device 40, the residuals on the intermediate transfer belt 7 are scraped off by the fur brush 41, and collected by the cleaning roller 42. The residuals are scraped off by the blade 43 from the surface of the cleaning roller 42 are collected in a recovery unit, not shown in the figure, by the recovery spiral 44.

Secondary Transfer Roller

The secondary transfer roller 8 transfers the image on the intermediate transfer belt 7 onto a print sheet. It is located below the driving roller 35, in contact with the transfer belt 7 and sandwiching it with the driving roller 35. Bias voltage is applied to the secondary transfer roller 8 by an energizing means, not shown in the figure, to transfer the image onto the print sheet.

Fixing Device

The fixing device 9 fixes the toner image on the print sheet by fusion. It is located below the rotary developing device 3 toward the left side. The fixing device 9 comprises a heating roller 9*a* having a built-in heater and a pressure roller 9*b* pressing against the heating roller 9*a* for pinching the print sheet in order to convey the same.

Discharge Portion

A discharge surface 50, covering the laser unit 4, the toner supply device 6, and the toner container 5, catches the print sheet with the image formed thereon when it is discharged. The discharge surface 50 curves upward gradually from the left to the right, and the inclination stops at some point above the toner container 5, and continues to extend in the horizontal direction.

Sheet Feeding Unit and Conveyance Unit

A sheet feeding cassette 52 with a stack plate for stacking sheets to be printed is located at the bottom of the device. A sheet feeding unit 51 launches out sheets from the sheet feeding cassette 52 from the bottom right corner, in FIG. 1. The sheet feeding unit 51 has a forward feeding roller 53 for picking up sheets of paper on the stack plate and a sheet feeding control mechanism 54, where a pair of rollers sends one sheet of paper at a time into the conveyance path. The sheet feeding cassette 52 can be pulled out of the device from the right side.

The conveyance mechanism conveys sheets from the sheet feeding unit 51 to the discharge portion 50. The conveyance mechanism comprises a first conveyance path 55 from the sheet feeding unit 51 to the secondary transfer roller 8, a second conveyance path 56 from the secondary transfer roller 8 to the fixing device 9, and a third conveyance path 57 from the fixing device 9 to the discharge portion 50. A branching claw 58 is located at the exit of the fixing device 9. Located between this branching claw 58 and the first conveyance path 55 is a return conveyance path 59 for returning sheets to the first conveyance path 55.

The first conveyance path 55 has a curved path 55*a* conveying the sheet upward, sent from the sheet feeding cassette 52, and a straight path 55*b* extending from the curved path 55*a* to the secondary transfer roller 8. These conveyance paths are composed of guide plates and pairs of rollers for guiding and conveying the sheets. On these conveyance paths, sensors are installed at certain places for detecting the location of the sheet. In addition, on the straight path 55*b*, a pair of paper stop rollers 60 controls the conveyance timing of the sheet.

The second conveyance path 56 extends rectilinearly. Guide plates, pairs of rollers for guiding and conveying sheets, and sensors can be found on the second conveyance path 56 as well.

The third conveyance path 57 includes a vertical conveyance path formed downstream of the branching claw 58 in the conveyance direction. Namely, the sheet is conveyed upward in the vertical direction after passing the branching claw 58 and is discharged to the discharge portion 50. The third conveyance path 57 is also composed of guide plates and pairs of rollers for guiding and conveying the sheets.

The return conveyance path 59 is a conveyance path which branches off downward from the third conveyance path 57 at a place where the branching claw 58 is mounted and extends below the fixing device 9, the second conveyance path 56, the secondary transfer roller 8 and the pair of the paper stop rollers 60, and then extends upward so as to join upstream of the pair of the paper stop rollers 60 in the first conveyance path 55 in the conveyance direction. Namely, the return conveyance path 59 is a conveyance path located vertically between the sheet feeding cassette 52 and the straight path 55*b* of the first conveyance path 55 as well as the second conveyance path 56. The path 59 returns the sheet passed through the fixing device 9 upstream of the pair of the paper stop rollers 60, located upstream of the secondary transfer roller 8. The return conveyance path 59 also has the guide plates, pairs of rollers for guiding and conveying sheets, and the sensors.

At the very end of the right side of the device is a sheet feeding tray 65, forming a lateral wall on the right side of the device. The sheet feeding tray 65 has a pivot 65*a* at the lower end, allowing the sheet feeding tray 65 to pivot open and stop at a determined position when pulled out in a clockwise direction. It can open and close freely. Accordingly, when the sheet feeding tray 65 is opened, it is possible to put sheets thereon and supply them into the device to the curved path 55*a* of the first conveyance path 55. Furthermore, the sheet feeding tray 65 is unified with the sheet feeding cassette 52, the first conveyance path 55, the second conveyance path 56, the return conveyance path 59, and the sheet feeding tray 65, as the sheet conveyance unit. The sheet conveyance unit can be pulled out from the right side of the device.

Image Forming Operation

Below is a brief explanation with regard to the image forming operation. When the power of the device is turned on, a variety of parameters and settings are initialized, such as the temperature of the fixing device. When a command to print the image data is received from a computer connected to the printer, the image forming operation carries out the following functions. Note that while the image forming operation performs these functions, the toner supply pipe 25 stays in the retracted position.

First, the charge roller 10 charges the photosensitive drum 2. The laser unit 4 scans and exposes the photosensitive drum 2 based on the image data to form the electrostatic latent image on the surface of the photosensitive drum 2. The rotary developing device 3 rotates to the position where the sub rotary developing unit 16 with the designated color is positioned adjacent to the photosensitive drum 2. The electrostatic latent image on the photosensitive drum 2 is developed with this designated toner color, and transferred to the intermediate transfer belt 7. Note that various toner colors are applied to the electrostatic latent image before it is transferred to the intermediate transfer belt 7. The residual toner remaining on the photosensitive drum 2 is cleaned by the drum cleaning device 11, and discharged to a waste toner container, not shown in the drawing.

The sheet feeding unit 51 draws sheets from the sheet feeding cassette 52 with the forward feeding roller 53 and the sheet feeding control mechanism 54. The sheet drawn out is conveyed to the pair of the paper stop rollers 60 through the first conveyance path 55. It is further conveyed to the secondary transfer roller 8 when the image on the intermediate transfer belt 7 is ready to be transferred onto the secondary transfer roller 8, in contact with the intermediate transfer belt 7. The full color image is then transferred to the print sheet by a transfer bias applied to the secondary transfer roller 8. The print sheet is guided to the fixing device 9 through the second conveyance path 56. The image is fixed onto the print sheet by heat and pressure in the fixing device 9. For a single-sided printing, the sheet is guided to the third conveyance path 57 by the branching claw 58, and discharged onto the discharge portion 50.

For a double-sided printing, after the image is fixed onto the sheet in the fixing device 9, the sheet is returned back to the first conveyance path 55. From the fixing device 9, the sheet is temporarily conveyed to the third conveyance path 57; however, when the trailing edge of the sheet passes the branching claw 58, it is conveyed back in the reverse direction to the return conveyance path 59, and returned to the first conveyance path 55 again. It is then temporarily held by the pair of the paper stop rollers 60, until the intermediate transfer belt 7 is ready to transfer image again. The pair of the paper stop rollers 60 conveys the sheet toward the secondary transfer roller 8. The image is formed on the other surface of the print sheet, and it is guided to the third conveyance path 57 by the branching claw 58 and discharged onto the discharge portion 50.

Toner Supply Operation

Toner is supplied from the toner supply pipe 25, comprised in the toner supply device 6, to the sub rotary developing units 16. The toner supply pipe 25 moves downward to the sub rotary developing unit 16 in position shown in FIG. 1. The motor 33*a* drives the pinion gear 33 so that the toner supply pipe 25, attached to the rack 32, moves downward. The rotary developing unit 3 is locked against the rotation. Meanwhile, the toner from the toner container 5 is being conveyed to the toner supply pipe 25 by the rotation of the coil spring 31 in the conveyance pipe 26. The tip of the toner supply pipe 25 advances into the sub rotary developing unit 16 through the slit 18*a*.

The tip of the toner supply pipe 25 is closed when it is not inside the slit 18*a*, as shown in FIG. 6(*a*). The line of the opening 252*a* is parallel with the line of the slit 18*a* when the tip is in the closed position. Then, as the toner supply pipe 25 moves toward the slit 18*a*, the protrusion of the outer cylinder 252 is guided to the spiral flutes 28*a* of the rotary cam 28 to rotate the outer cylinder 252 relative to the inner cylinder 251. Thus, when the tip of the toner supply pipe 25 is inserted in the sub rotary developing unit 16, the line of the opening 252*a* and the line of the slit 18*a* are perpendicular as shown in FIG. 6(*b*). The opening 252*a* and the opening 251 a are aligned, and the shutter mechanism is opened.

The reason that it is preferable for the line of the opening 252*a* and the line of the slit 18*a* to be parallel before the toner supply pipe 25 is inserted to a toner supply position, and perpendicular when it is in the toner supply position, is explained as follows. An experiment was conducted, inserting the toner supply pipe 25 one thousand times into the sub rotary developing unit 16, both with the lines of the openings in the parallel and in the perpendicular directions. As a result, when the line of the opening 252*a* and the line of the slit 18*a* are approximately perpendicular when the tip is inserted, and the outer cylinder 252 begins to turn so that the line of the opening 252*a* would be parallel to the line of the slit 18*a* in the supply position, the elastic seal 18*b* was torn by the turning force. However, if the line of the opening 252*a* and the line of the slit 18*a* were parallel when the tip of was inserted, even after the outer cylinder 252 turns so that the line of the opening 252*a* would be perpendicular to the line of the slit 18*a* in the supply position, as according with the present invention, the elastic seal 18*b* was not torn by the turning force. Note that when the tip of the toner supply pipe 25 enters the slit 18*a*, slit 18*a* is stretched, and the portion from the points 18*c* to 18*e* of the slit 18*a* is especially tightly wrapped around the tip of the toner supply pipe 25. Therefore, if the line of the opening 252*a* and the line of the slit 18*a* were nearly perpendicular when entering slit 18*a*, as shown in the left side in FIG. 8, while the outer cylinder 252 continues to turn, since the left opening edge portion 18*c* of the opening is near the end point of the slit 18*a*, when pulling the seal in a clockwise direction, it is likely to torn the slit at the end point due to the frictional resistance. On the other hand, according to the present invention, if the line of the opening 25 was nearly parallel with the line of the slit 18*a*, as shown in the right in FIG. 8, since the portion of the slit pulled by this rotation will be the distance from point 18*c* to the end point at the right, this distance is much longer than the distance from point 18*c* to the bottom end point in the left figure; therefore, the seal is able to stretch longer and not torn by the rotation. Furthermore, the line of the slit 18*a* and the line of the opening 252*a* of the toner supply pipe are designed to be perpendicular with each other when the toner supply pipe 25 is in the supply position. This is because that as shown in FIGS. 6(*b*) and (*c*), a part of the elastic seal 18*b* is drawn inside the sub rotary developing units 16 when the toner supply pipe 25 passes through the slit 18*a*. It is possible that the part of the elastic seal 18*b* being drawn inside will cover the opening 252*a*. Thus, by having the supply position set according to the present invention will prevent the opening 252*a* from being blocked, which the toner will not be properly supplied. Accordingly, the distance from the toner supply pipe 25 to the sub rotary developing units 16 can be minimized, and it is possible to decrease the time and space required to move the toner supply pipe 25 from the retracted position to the toner supply position.

Also, every time the toner supply pipe 25 passes through the slit 18*a*, the elastic seal 18*b* is under stress. In other words, every time the toner supply pipe 25 passes through the elastic seal 18*b*, it receives a resistance from the elastic seal 18*b*. However, since the opening of the case 17 is in a rectangular shape, the resistance from the elastic seal 18*b* is being reduced. Alternatively, having a rounded opening on the case 17 to conform to the shape of the toner supply pipe 25 is another alternative; however, if there were enough space to form a circular opening, it would be preferable to have a larger rectangular opening with the length of the side of the rectangular be as long as the diameter of the circular opening, to increase the area of the seal so that resistance from the elastic seal 18*b* is reduced when the toner supply pipe 25 is inserted.

Note that although the toner supply pipe 25 blocks the laser light path emitting from the laser unit 4 to the photosensitive drum 2, when it is in the supply position, it is not a problem, because the toner supplying operation and the image forming operation are not carried out simultaneously.

The coil spring 31 in the conveyance pipe 26 stops rotating when the toner supplying process is complete. On the other hand, the toner conveyance screw 30 located inside the toner supply pipe 25 continues to rotate until the toner is completely emptied in the toner supply pipe 25. Then, the motor 33a rotates in a reverse direction to rotate the pinion gear 33 in the reverse direction so that the toner supply pipe 25, attached to the rack 32, moves upward. At this time, the outer cylinder 252 rotates in the reverse direction and that the opening 251*a* and the opening 252*a* are no longer aligned with each other. The opening, or the shutter, is being closed. Moreover, when the toner supply pipe 25 is pulled out from the slit 18*a*, the slit 18*a* is also closed by the elastic force. Therefore, toner does not splash the device.

Note that the movement of the tip of the toner supply pipe 25 in a toner supply operation is performed at a rate of 2 mm to 20 mm per second. Certainly the tip of the toner supply pipe 25 can go through and insert into the slit 18*a*, since even a brush motor with low torque can move the toner supply pipe 25.

Another Embodiment

Figure 7A:
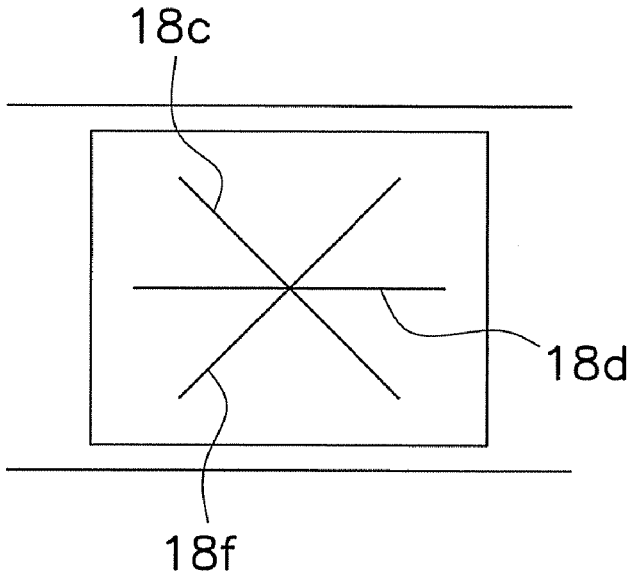
FIG. 7A is a plan view of an elastic member with multiple slits in an alternative embodiment.
Figure 7B:
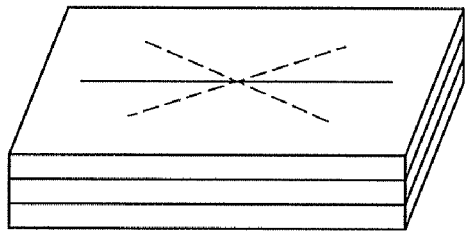
FIG. 7B is a perspective view of an elastic member with multiple layers and multiple slits in an alternative embodiment.

In the above embodiment, the elastic member has only one slit. However, the elastic member can have multiple slits 18*c*, 18*d*, and 18*f*, extending in different directions, as shown in FIG. 7. Furthermore, it may be possible to employ an elastic seal consisting of a plurality of layers of elastic sheets in a laminated manner, each having one slit extending in a different direction.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A developing unit, comprising:

a case having an opening;

an elastic seal having a slit formed therein; and a toner supply device having a nozzle at the tip thereof, the toner supply device supplying toner to the case via the nozzle, the toner supply device including an inner cylinder having an inner opening formed in the tip thereof and an outer cylinder having an outer opening in the tip thereof, the outer cylinder relatively rotatable about the outer circumferential side of the inner cylinder, and a shutter mechanism constructed such that when the tip of the toner supply device advances into the case, at least a portion of the inner opening and the outer opening overlap with respect to each other, and when the tip is positioned outside the case, the inner opening and the outer opening are misaligned with respect to each other.

2. A developing unit, comprising:

a case having an opening;

an elastic seal having a slit formed therein;

a toner supply device having a nozzle at the tip thereof, the toner supply device supplying toner to the case via the nozzle, the toner supply device including an inner cylinder having an inner opening formed in the tip thereof and an outer cylinder having an outer opening in the tip thereof, the outer cylinder relatively rotatable about the outer circumferential side of the inner cylinder; and a shutter mechanism constructed such that when the tip of the toner supply device advances into the case, at least a portion of the inner opening and the outer opening overlap with respect to each other, and when the tip is positioned outside the case, the inner opening and the outer opening are misaligned with respect to each other; and a drive device for advancing the tip of the nozzle of the toner supply device into and out of the case through the slit of the elastic seal.

3. The developing unit according to claim 2, wherein the outer opening of the toner supply device is formed on a lateral surface of the tip of the outer cylinder in one portion of the circumference thereof such that an open surface of the outer opening and the slit are arranged to be approximately parallel with each other when the nozzle passes through the slit.

4. The developing unit according to claim 2, wherein the outer cylinder and the inner cylinder begin to rotate relative to each other immediately before the toner supply device begins to pass through the slit, and the open surface of the outer opening and the slit are approximately perpendicular with each other when the outer opening is completely accommodated in the case.

5. The developing unit according to claim 2, wherein the outer opening of the outer cylinder has an opening angle larger than that of the inner opening of the inner cylinder.

6. The developing unit according to claim 5, wherein the elastic seal has a plurality of laminated elastic sheets, each elastic sheet having one slit extending in a different direction.

7. The developing unit according to claim 5, wherein at least one of the surfaces of the slit and the surface of the elastic seal are surface treated.

* * * * *